US005610584A

United States Patent [19]

Schrade

[11] Patent Number: 5,610,584

[45] Date of Patent: Mar. 11, 1997

[54] DETECTION OF GOODS ON THE BOTTOM RACK OF A CART

[76] Inventor: Chester R. Schrade, 5-768 Toronto Street, Winnipeg, Manitoba, Canada, R3E 1Z6

[21] Appl. No.: 433,192

[22] Filed: May 2, 1995

[51] Int. Cl.[6] ..... G08B 13/14

[52] U.S. Cl. ..... 340/568; 340/556; 340/674; 250/222.1

[58] Field of Search ..... 340/555, 556, 340/557, 568, 674, 572; 250/222.1

[56] References Cited

U.S. PATENT DOCUMENTS

| | | | |
|---|---|---|---|
| 3,725,894 | 4/1973 | Geisler | 340/568 |
| 3,746,863 | 7/1973 | Pronovost | 340/556 |
| 4,327,819 | 5/1982 | Coutta | 340/568 |
| 4,338,594 | 7/1982 | Holm | 340/556 |
| 4,650,990 | 3/1987 | Jonsson | 340/556 |
| 4,725,822 | 2/1988 | Hooley | 340/568 |
| 4,736,098 | 4/1988 | Rehrig | 340/568 |
| 4,843,461 | 6/1989 | Tatsumi et al. | 358/108 |
| 5,337,040 | 8/1994 | Kind | 340/572 |
| 5,485,006 | 1/1996 | Allen et al. | 250/222.1 |
| 5,500,526 | 3/1996 | Shalui et al. | 250/222.1 |

*Primary Examiner*—Jeffery Hofsass
*Assistant Examiner*—Benjamin C. Lee
*Attorney, Agent, or Firm*—Adrian D. Battison; Murray E. Thrift

[57] ABSTRACT

A device is provided at a check stand for detecting the presence of goods on a shopping cart of the type including two bottom rails, a plurality of wheels beneath the bottom rails and a rack mounted on the bottom rails for supporting goods thereon. The device comprises an alarm for indicating to a person at the check stand, optical transmitters for transmitting a plurality of beams of light across an alleyway to optical receivers, the transmitters and receivers being positioned in a pattern to be responsive to the shape of the cart having goods on the rack while being not responsive to the shape of a cart having an empty rack and being not responsive to persons. The pattern defines a first row of three optical transmitter elements which are horizontally spaced longitudinally of the alleyway and a second row of two optical transmitter elements arranged at a height relative to the floor below the rail. The transmitters of the first row and the receivers of the second row are mounted on a first detection member mounted on one side of the alley and the receivers of the first row and the transmitters of the second row are mounted on a second detection member mounted on the other side of the alley. The second row of transmitters are arranged to transmit only in response to detection by the first row of a condition in which no beams are detected. A control circuit is responsive to a condition in which the optical receivers of the second row receive the beam from the respective optical transmitter element of the second row for actuating the alarm means.

20 Claims, 4 Drawing Sheets

DETECTION OF GOODS ON THE BOTTOM RACK OF A CART

BACKGROUND OF THE INVENTION

This invention relates to an apparatus for detecting the presence of goods on the bottom rack of a shopping cart in order to provide an alarm condition on detection of such goods for the purposes of preventing such goods inadvertently passing a store check stand without being checked for payment. While the present invention is described in relation to use in a store with shopping carts, it will be appreciated that use in other situations is also possible within the scope of the invention for example in warehousing or the like.

Supermarkets and other stores are generally now set out with a row of check stands so that between each check stand and the next adjacent check stand is an alleyway through which the customers can pass pushing a shopping cart which has been used to carry their goods to the check stand and is then used to carry the goods away from the check stand.

In order to reduce staffing levels, such stores generally require that the customer place the goods onto the check stand for checking for payment and then the customer pushes the emptied shopping cart through the alleyway for collection of the goods after checking.

Such shopping carts generally include a pair of parallel horizontal bottom rails spaced apart the width of the shopping cart with four ground wheels located underneath the bottom rails. A pair of posts stand up from the bottom rails and support a large top rack for receiving the majority of the goods selected by the shopper. Most shopping carts also include a bottom rack between the bottom rails for receiving additional goods often of a larger or bulky nature.

In the busy store situation, it is possible that the customer forgets to place onto the check stand those goods on the bottom rack and the cashier may in some cases not notice such goods. This possibility is sufficiently common to constitute a significant loss of revenue for the stores.

SUMMARY OF THE INVENTION

It is one object of the .present invention, therefore, to provide an apparatus for detecting such goods on the bottom rack.

According to one aspect of the invention there is provided a combination comprising: a cart for transporting goods including two bottom rails, a plurality of wheels beneath the bottom rails and a rack mounted on the bottom rails for supporting goods thereon; a check stand comprising a floor, a first and a second wall member each upstanding from the floor and defining between the wall members an alleyway through which persons and carts can pass; detection means for detecting goods on the bottom rack of a cart as it passes through the alleyway and for providing a signal in response thereto; and alarm means for indicating to a person at the check stand receipt of a signal from the detection means; the detection means comprising optical transmitter for transmitting a plurality of beams of light, optical receiver means responsive to receipt of light from at least one of the beams, the optical transmitter means and optical receiver means being arranged such that said plurality of beams of light are transmitted across the alleyway; said optical transmitter means and optical receiver means being positioned in a pattern which is shaped and arranged relative to a shape of the cart having goods on the rack so as to be responsive to the shape of the cart having goods on the rack while being not responsive to the shape of a cart having an empty rack and being not responsive to persons.

According to a second aspect of the invention there is provided a combination comprising: a cart for transporting goods including two bottom rails, a plurality of wheels beneath the bottom rails and a rack mounted on the bottom rails for supporting goods thereon; a check stand comprising a floor, a first and a second wall member each upstanding from the floor and defining between the wall members an alleyway through which persons and carts can pass; detection means for detecting goods on the bottom rack of a cart as it passes through the alleyway and for providing a signal in response thereto; and alarm means for indicating to a person at the check stand receipt of a signal from the detection means; the detection means comprising optical transmitter for transmitting a plurality of beams of light, optical receiver means responsive to receipt of light from at least one of the beams, the optical transmitter means and optical receiver means being arranged such that said plurality of beams of light are transmitted across the alleyway; the detection means comprising optical transmitter for transmitting a plurality of beams of light, optical receiver means responsive to receipt of light from at least one of the beams, the optical transmitter means and optical receiver means being arranged such that said plurality of beams of light are transmitted across the alleyway; wherein the optical transmitter means and optical receiver means comprises a plurality of optical transmitter elements and a plurality of optical receiver elements at least some of the optical transmitter elements and the optical receiver elements being mounted on a first detection element supported at the first wall member and at least some of the optical transmitter elements and optical receiver elements being mounted on a second detection element supported at the second wall member, the first and second detection elements being free from connecting wires therebetween.

According to a third aspect of the invention there is provided a combination comprising: a cart for transporting goods including two bottom rails, a plurality of wheels beneath the bottom rails and a rack mounted on the bottom rails for supporting goods thereon; a check stand comprising a floor, a first and a second wall member each upstanding from the floor and defining between the wall members an alleyway through which persons and carts can pass; detection means for detecting goods on the bottom rack of a cart as it passes through the alleyway and for providing a signal in response thereto; and alarm means for indicating to a person at the check stand receipt of a signal from the detection means; the detection means comprising optical transmitter for transmitting a plurality of beams of light, optical receiver means responsive to receipt of light from at least one of the beams, the optical transmitter means and optical receiver means being arranged such that said plurality of beams of light are transmitted across the alleyway; the detection means comprising optical transmitter for transmitting a plurality of beams of light, optical receiver means responsive to receipt of light from at least one of the beams, the optical transmitter means and optical receiver means being arranged such that said plurality of beams of light are transmitted across the alleyway; wherein the optical transmitter means are arranged in a pattern providing a first row of optical transmitter means containing a plurality of the optical transmitter means, the first row being arranged at a height from the floor equal to the height of goods on the rack, the row being horizontally spaced longitudinally of the alleyway; wherein the optical transmitter means includes a second row of optical transmitter elements arranged at a height relative to the floor below the rail and including a plurality of optical transmitter elements which are horizontally spaced longitudinally of the alleyway; and including a first detection element mounted at the first wall member and a second detection element mounted at the second wall member, the first row of optical transmission elements being arranged on the first detection element, the first row of optical detection elements being arranged on the second detection element, the second row of optical transmission elements being arranged on the second detection element and the second row optical reception elements being mounted on the first detection element.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
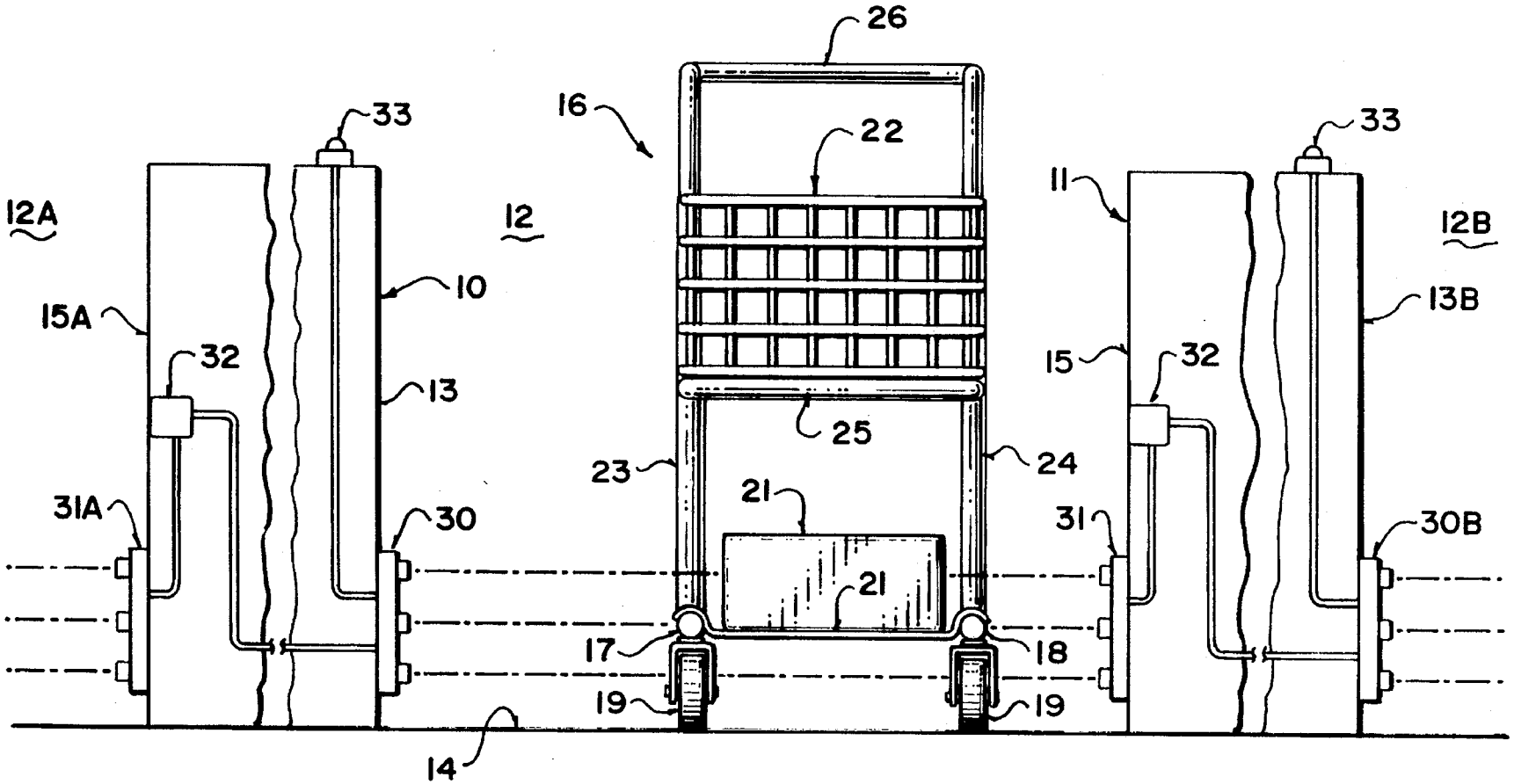
FIG. 1 is a vertical cross sectional view through a check stand of a store showing a shopping cart and a detection apparatus for detecting goods on the bottom rack of the shopping cart.

In FIG. 1 is shown a check stand arrangement of a store of a type in which there is arranged a row of the check stands which are substantially identical for receiving the customers and shopping carts pushed by the customers for transportation of goods selected by the customers for checking at the check stand for payment. Thus the check stand comprises a first check stand counter 10 and a second check stand counter 11 defining therebetween an alleyway 12, The first check stand counter 10 includes a vertical wall 13 standing upwardly from a floor 14 and defining one side wall of the alleyway 12. The second check stand counter 11 similarly includes a vertical wall 15 parallel to the wall 13. One of the check stand counters 10 and 11 is associated with the alleyway 12 so that a cashier stands at the check stand counter and checks purchased goods positioned onto the check stand counter by the customer from the shopping cart indicated at 16. The details of the check stand counters are not shown as these are well known to one skilled in the art and themselves do not form a part of the present invention.

The shopping cart 16 comprises two base rails 17 and 18 which are parallel and horizontal and define sides of the cart at a position adjacent the floor 14. On the underside of the rails is mounted ground wheels 19 which are spaced in pairs forwardly and rearwardly of the shopping cart. Between the rails 17 and 18 is mounted a bottom rack 20 onto which goods 21 can be placed for transportation with the shopping cart. It is well known that many shoppers choose to place bulky items on the bottom rack to separate them from more delicate items in the top rack indicated at 22. The top rack is mounted upon a pair of posts 23 and 24 together with a cross rail system 25 which defines a frame supporting the top rack. The handle 25 is provided for pushing the cart around the store and through the alleyway 12.

The rails 17 and 18 are parallel and substantially horizontal and extend from the front to the rear of the shopping cart. The wheels 19 are positioned at the front and rear of the rails to define open space 27 between the wheels 19 as best shown schematically in FIG. 2.

The detection apparatus for detecting the article 21 on the bottom rack 20 comprises a first detection member 30 and a second detection member 31. The first detection member 30 is mounted on the first wall 13 and the second detection member is mounted on the second wall 15. The counter 10 of course cooperates with a second alleyway 12A on the opposite side wall from the wall 13. A second detection apparatus therefore is provided for the alleyway 12 and comprises a second detection member 31A mounted on a wall 15A of the counter 10. The detection member 31A and the detection member 30 are commonly powered from a transformer power supply 32 mounted in the counter 10. An alarm device 33 from the first detection member 30 is also provided on the counter for providing a suitable indication to the cashier when an article 21 is detected. The construction of the alarm is again well known to one skilled in the art and various types of alarm can be used depending upon various parameters.

Similarly the detection member 31 in the counter 11 is powered from a second power supply 32 which acts to provide power to the member 31 and to a further member 30B provided on a wall 13B opposite to the wall 15 of the counter 11. The only wiring to the detection members therefore occurs within the counters and there is no wiring which extends from the detection member 30 to the detection member 31. There is no need therefore for any wiring to extend under the floor or overhead so the counters can remain separated.

Each of the detection members contains a plurality of optical transmission elements indicated generally at T and a plurality of optical receiver elements indicated generally at R. The optical transmission and receiver elements are arranged to transmit and receive at a common wavelength which may be a wave length of the order of 940 nm which is close to the lower end of the visible band and is readily available in commercially available items. The transmitters are generally of the LED type. The receivers are photo transistors which are associated with suitable circuitry to operate at the above frequency in order that they are not affected by the ambient light.

Figure 5:
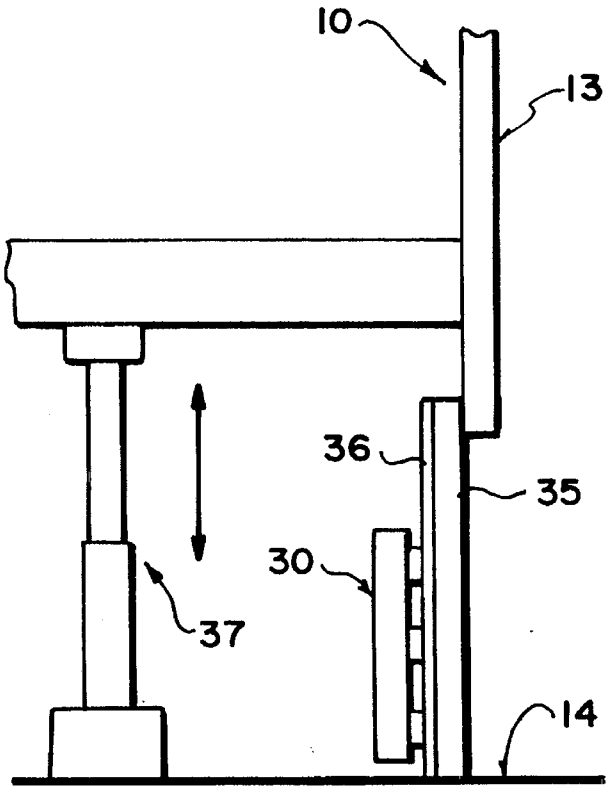
FIG. 5 is a vertical cross sectional view showing the mounting of the detection element and the based of the check stand.

As shown in FIG. 5 the detection members 30 are mounted in the front wall 13 behind the screen 35. The screen has a coating 36 of a colored material which is selected so that it is nearly opaque in the visible range but transparent at 940 nm so as to allow the penetration of the light beams for transmission and reception but so as to appear visually dark to an observer so that the observer cannot detect the pattern of the detection members 30. The detection member is mounted at a predetermined height from the floor 14 which is independent of the adjustment system 37 for the counter 10.

Figure 2:
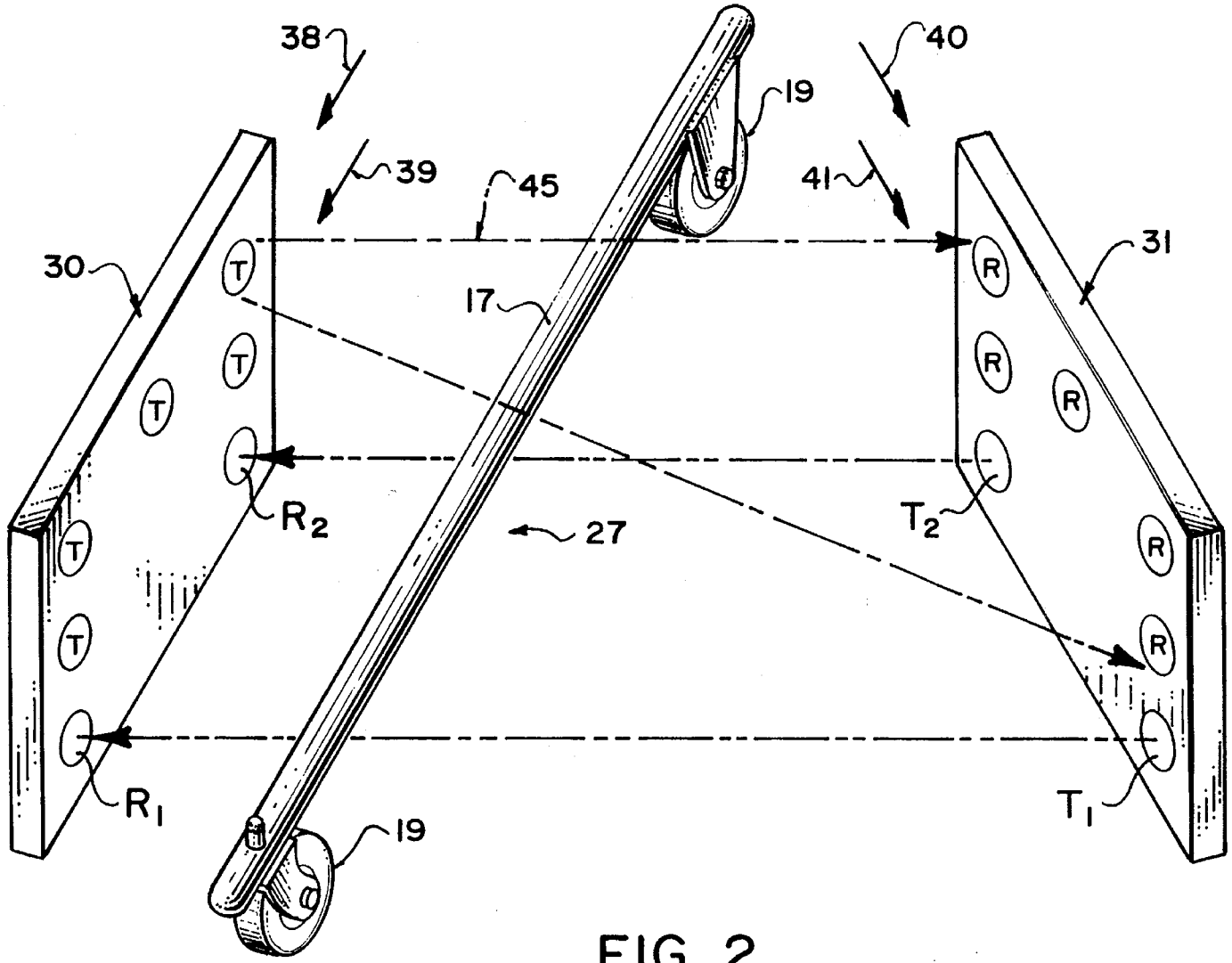
FIG. 2 is a schematic isometric view showing the arrangement of transmitters and receivers on the two separate detection elements.
Figure 4:
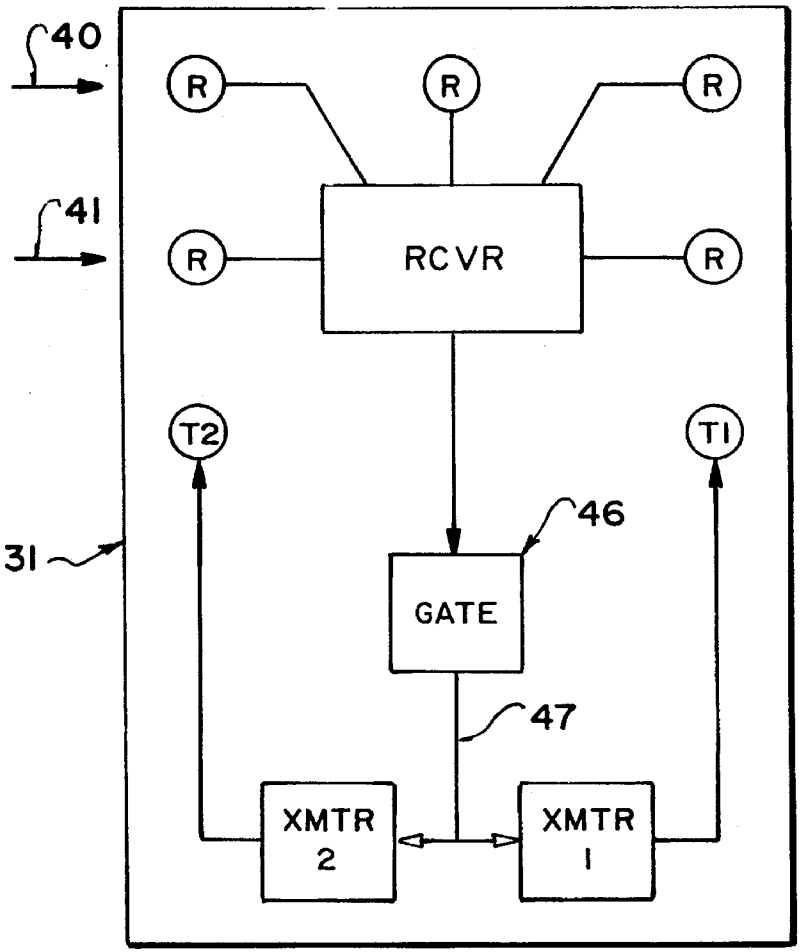
FIG. 4 is a schematic circuit diagram of the second detection element of FIG. 1.
Figure 3:
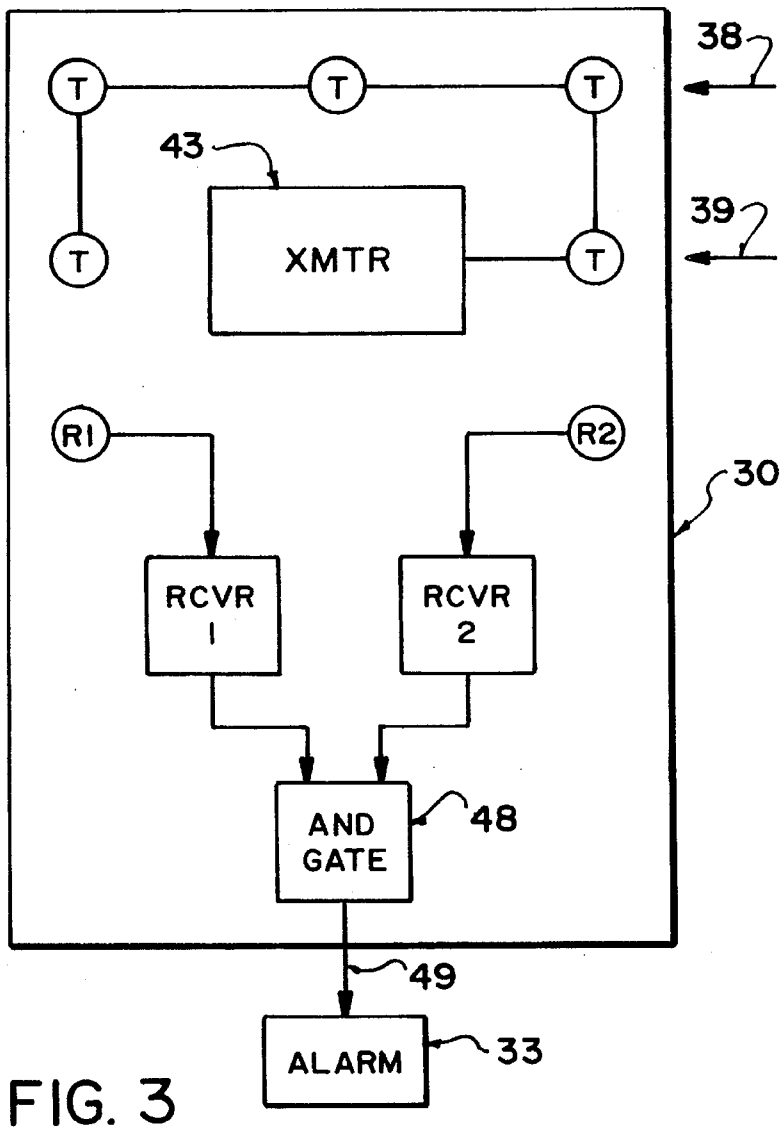
FIG. 3 is a schematic circuit diagram for the first detection element of FIG. 1.
Figure 6:
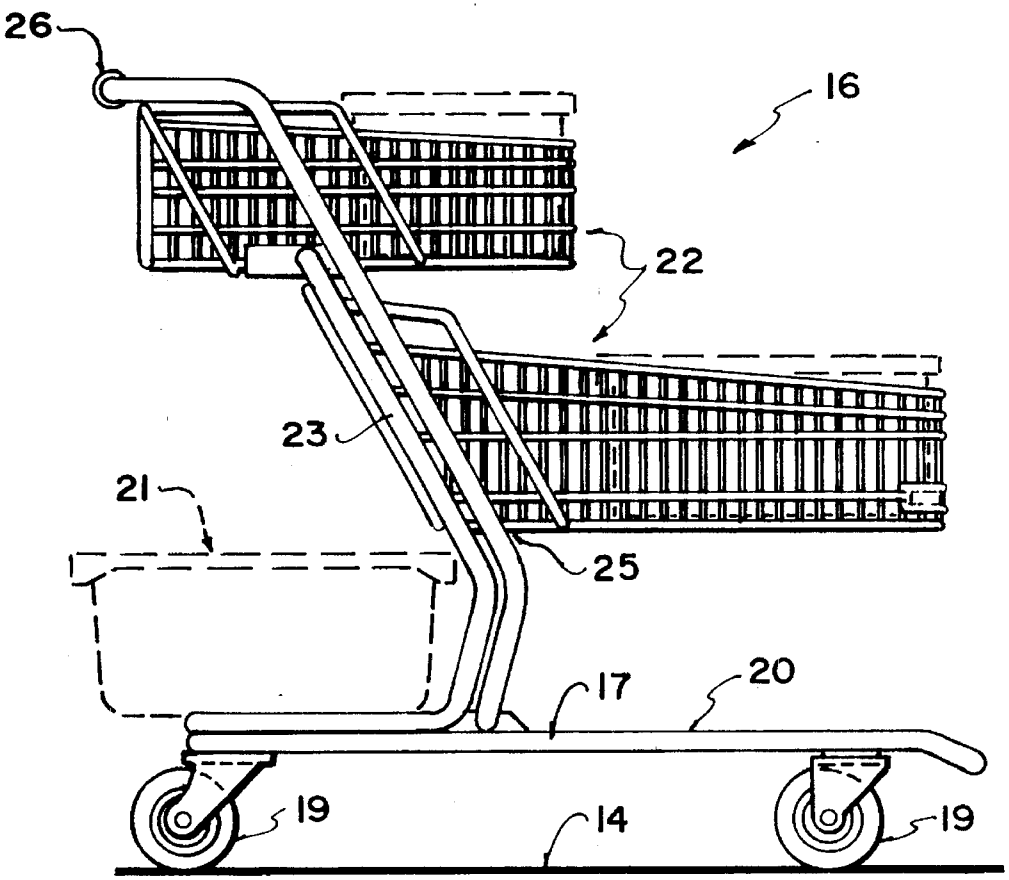
FIG. 6 is a side elevational view of a type of cart with which the above embodiment is particularly concerned.

As shown in FIGS. 2, 3 and 4, the detection member 30 is arranged with a transmitter including two rows of transmitter elements and a receiver having one row of receiver elements. Thus the detection member 30 includes a first row 38 of transmitter elements T and a second row 39 of transmitter elements T. The detection member 31 is arranged symmetrically with a receiver having a first row 40 of receiver elements R and a second row 41 of receiver elements R. In the first rows 38 and 40 there are three such elements in the second rows 39 and 41 there are two such elements. The elements in the rows are spaced horizontally that is longitudinally of the alleyway and lie in a common horizontal line. The three elements of the top row are equidistantly spaced. The two elements of the second row are spaced so that they lie respectively underneath the outer two of the three elements of the top row. The elements of the second rows 39 and 41 are arranged as shown in FIG. 1 at a common height with the rails 17 and 18. The top rows 38 and 40 are arranged above the rails 17 and 18 so as to be aligned with an article 21 arranged on the rack 20. The spacing above the center line of the rails is selected to be of the order of 1½ to 2 inches so as to accommodate unevenness in the floor and inaccuracies in the cart and the fact that the bottom rack is not horizontal to allow stacking of the carts.

As shown in FIG. 3, the transmitter elements T of the transmitter 39 are all connected in series to the transmitter which generates square wave pulses at a 50% duty cycle at a predetermined frequency of the square wave. The frequency of the light generated by the transmitters is as previously stated a common frequency to all of the transmitters and receivers. However the pulses generated by the transmitter 43 are particular to that generator and thus generate over all of the transmitter elements T of the first and second rows a common frequency. The transmitter elements have an angle of transmission of the order of 20° and the receiver elements have an angle of reception at the order of 10°. Thus as indicated by the dotted lines 45 in FIG. 2, each one of the transmitter elements T can be observed by all of the receiver elements R. This therefore generates 25 light paths.

The receiver elements of the detection member 31 are responsive to light transmitted from the transmitter elements T and thus generate a signal on detection of the light at the predetermined frequency set by the pulse generator 43. On detection of light at this frequency, each receiver generates a signal which is transmitted to a gate 46 of the member 31. The gate thus generates zero output when any one of the receiver elements R is emitting a signal indicating the reception of light from the transmitter elements T. Only therefore when all of the receiver elements are blanked out by the presence of obstacles between the transmitter elements and the receiver elements does the gate generate a pulse on an output line 47 for activating a transmitter xmtr 1 and a transmitter xmtr 2 of the detection member. The transmitter xmtr 1 is arranged to generate pulses to a transmitter element T1 which are at a frequency different from that of the transmitter 43. The transmitter xmtr 1 generates a frequency transmitted by the optical transmitter element T1 and a second transmitter xmtr 2 activated by the output 47 which is a frequency separate and distinct from that of the transmitter xmtr 1 generates an output on the transmitter element T2.

The detection member 30 further includes the receiver element R1 and the receiver element R2 each of which is tuned to the specific frequency of the transmitters xmtr 1 and 2 respectively. The receiver element R1 is therefore only responsive to transmission from the transmitter element T1 and the receiver element R2 is responsive only to transmission from the transmitter element T2.

The receiver elements 1 and 2 are connected to an and gate 48 which is responsive to signals output from the receiver element 1 and 2 and generates an output signal 49 only when there is the presence of an output from each of the receiver elements 1 and 2 with the output 49 communicating with the alarm 33.

In operation the transmitter 43 and the transmitter elements T are continually operating to generate the high frequency transmissions which are emitted from the transmitter elements T. The receiver elements R are continually looking for the light beams from the transmitter elements T and continually produce an output whenever light from at least one of the transmitter elements T is detected. The light can be blocked, due to an approximate source width of the order of 3 mm, from all of the transmitter elements by a person standing in front of the member 30 or between the members 30 and 31. Also the light can be blocked by a cart as shown in FIG. 1 which has the rails 17 and 18 for blocking the light from the second row 39 of transmitter elements and an article 21 on the rack which blocks the light from the top row of transmitter elements. It is a situation, therefore, where all of the receiver elements are blanked out and the receiver element 46 generates an output pulse at the output 47 thus causing the transmitter elements T1 and T2 to operate.

Only in the event that the light from both of the transmitter elements T1 and T2 is detected by the receiver elements R1 and R2 is the R alarm activated. In general this will only occur in the presence of a cart having an article 21. A cart having no article does not block the light to the receiver elements R and accordingly the transmitter elements T1 and T2 are not operated. A person standing between the members will block both the light from the transmitter elements T and also the light from the transmitter elements T1 and T2 so that the alarm is not activated.

The system is therefore set out in a pattern which looks for the particular shape of the cart with the article thereon and acts to distinguish this from other articles such as persons or unloaded carts. The particular pattern which is required to activate the alarm requires the space between the wheels as indicated at 27 to allow the light beams from the transmitter elements T1 and T2 to pass under the rails 17 and 18 to the receiver elements R1 and R2.

The second row 39 of transmitter elements is provided to avoid a situation where a skirt or coat of a particular length blocks the light from the top row 38 while the light from the transmitter elements T1 and T2 can pass under the skirt or coat to the receiver elements R1 and R2 thus providing a false alarm. It is most unlikely that the skirt would hang horizontally exactly at the height of the transmitter elements of the second row and the feet of the wearer of the coat or skit is sufficiently removed from the area to allow the light from both transmitter elements T1 and T2 to pass to the respective receiver elements. The addition of the central transmitter T and the central receiver R in the top row avoids the possibility where the post 23 and 24 block the light from the transmitter elements T of the top row without their being an article 21 in place.

The use of separate frequencies for the transmitter elements T1 and T2 is to ensure that receiver element R1 can be activated only by light from transmitter element T1 and that receiver element R2 can be activated only by light from transmitter element T2. This avoids the situation where the device could be triggered by a "reentrant" shape between a cuff of the pants of a person and the ankle of the person since the ankle will block the light from one of the transmitter elements T1 and T2. The horizontal spacing of the transmitter elements is arranged to be as large as possible which in a practical example is of the order of five (5) inches since this will generally avoid the possibility of the whole device being activated by "reentrant" Thus the elements T1 and T2 lie underneath the outermost ones of the elements T.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A combination comprising:

a cart for transporting goods including two bottom rails, a plurality of wheels beneath the bottom rails and a bottom rack mounted on the bottom rails for supporting goods thereon;

a check stand comprising a floor, a first and a second wall member each upstanding from the floor and defining between the wall members an alleyway through which persons and carts can pass;

detection means for detecting goods on the bottom rack of a cart as it passes through the alleyway and for providing a signal in response thereto;

and alarm means for indicating to a person at the check stand receipt of a signal from the detection means;

the detection means comprising:

optical transmitter means for transmitting a plurality of beams of light, optical receiver means associated with the transmitter means and responsive to receipt of light from at least one of the beams, the optical transmitter means and optical receiver means being arranged such that said plurality of beams of light are transmitted across the alleyway to said receiver means;

said optical transmitter means and optical receiver means being positioned in a pattern which is shaped and arranged relative to a shape of the cart having goods on the rack so as to be responsive to the shape of the cart having goods on the rack while being not responsive to the shape of a cart having an empty rack and being not responsive to persons;

the optical transmitter means being arranged in a pattern to define a first row of optical transmitter elements containing at least three of the optical transmitter elements which are horizontally spaced longitudinally of the alleyway and at a height relative to the floor which is above the bottom rails and a second row of optical transmitter elements arranged at a height relative to the floor which is below the bottom rails and including at least two optical transmitter elements which are horizontally spaced longitudinally of the alleyway;

the optical receiver means being arranged in a pattern to define a first row of optical receiver elements containing at least three of the optical receiver elements which are horizontally spaced longitudinally of the alleyway and at a height relative to the floor which is above the bottom rails and a second row of optical receiver elements arranged at a height relative to the floor which is below the bottom rails and including at least two optical receiver elements which are horizontally spaced longitudinally of the alleyway;

the beams from the optical transmitter elements of the second row being optically distinguishable one from the other and the optical receiver elements of the second row being responsive only to a beam from a respective one of the transmitter elements of the second row;

and a control circuit responsive to a condition in which none of the optical receiver elements of the first row are receiving a beam from the optical transmitter elements of the first row and in which both of the optical receiver elements of the second row are receiving the respective beam from the respective one of the optical transmitter elements of the second row for actuating the alarm means.

2. The combination according to claim 1 wherein the optical transmitter means includes a third row of optical transmitter elements arranged at a height from the floor equal to the rail height and wherein the optical receiver means includes a third row of optical receiver elements arranged at a height from the floor equal to the rail height.

3. The combination according to claim 1 wherein the control circuit is substantially instantaneously, without delay responsive to the condition.

4. The combination according to claim 1 wherein the first row of optical transmitter elements and the first row of optical receiver elements are arranged for detection by any one of the optical receiver elements of a beam of any one of the optical transmitter elements.

5. The combination according to claim 1 wherein the optical transmitter elements of the second row are optically distinguishable by each transmitting pulses at a predetermined different frequency and wherein the optical receiver elements are responsive only to the frequency of the respective optical transmitter element.

6. The combination according to claim 1 wherein the optical transmitter means and the optical receiver means are covered by a cover panel which is colored to allow transmission of light from the optical transmitter means while appearing visually sufficiently dark to prevent observation of the optical transmitter means.

7. The combination according to claim 1 wherein the check stand includes a first stand element having the first wall member thereon and a second stand element having the second wall member thereon, the first stand element having a further wall member opposed to the first wall member and the second stand element having a further wall member opposed to the second wall member, the further wall members forming adjacent alleyways and having thereon detection members from said adjacent alleyways, each of the stand elements having means for providing electrical power to both of the detection members thereon.

8. The combination according to claim 1 including a first detection member mounted at the first wall member and a second detection member mounted at the second wall member, the first row of optical transmitter elements being arranged on the first detection member, the first row of optical receiver elements being arranged on the second detection member, the second row of optical transmitter elements being arranged on the second detection member and the second row optical receiver elements being mounted on the first detection member.

9. The combination according to claim 8 wherein the second row of optical transmitter elements on the second detection member are arranged to transmit only in response to detection by the first row of optical receiver elements of a condition in which no beams are detected thereby.

10. The combination according to claim 1 wherein at least some of the optical transmitter elements and the optical receiver elements are mounted on a first detection member supported at the first wall member and at least some of the optical transmitter elements and the optical receiver elements are mounted on a second detection member supported at the second wall member, the first and second detection members being free from connecting wires therebetween.

11. The combination according to claim 10 wherein some of the optical transmitter elements are mounted on the first detection member and some of the optical transmitter elements are mounted on the second detection member and wherein some of the optical receiver elements are mounted on the first detection member and some of the optical receiver elements are mounted on the second detection member.

12. The combination according to claim 11 wherein the second detection member is arranged so as to actuate the optical transmission elements thereon in response to a detection of the condition in which none of the optical receiver elements of the second detection member is receiving a beam from the optical transmitter elements of the first detection member.

13. The combination according to claim 10 wherein the first and second detection members communicate therebetween optically.

14. A combination comprising:

a cart for transporting goods including two bottom rails, a plurality of wheels beneath the bottom rails and a bottom rack mounted on the bottom rails for supporting goods thereon;

a check stand comprising a floor, a first and a second wall member each upstanding from the floor and defining between the wall members an alleyway through which persons and carts can pass;

detection means for detecting goods on the bottom rack of a cart as it passes through the alleyway and for providing a signal in response thereto;

and alarm means for indicating to a person at the check stand receipt of a signal from the detection means;

the detection means comprising:

optical transmitter means for transmitting a plurality of beams of light, optical receiver means associated with the transmitter means and responsive to receipt of light from at least one of the beams, the optical transmitter means and optical receiver means being arranged such that said plurality of beams of light are transmitted across the alleyway;

said optical transmitter means and optical receiver means being positioned in a pattern which is shaped and arranged relative to a shape of the cart having goods on the rack so as to be responsive to the shape of the cart having goods on the rack while being not responsive to the shape of a cart having an empty rack and being not responsive to persons;

the optical transmitter means being arranged in a pattern to define a first row of optical transmitter elements which are horizontally spaced longitudinally of the alleyway and a second row of at least one optical transmitter element arranged at a height relative to the floor below the bottom rails;

the optical receiver means being arranged in a pattern to define a first row of optical receiver elements which are horizontally spaced longitudinally of the alleyway and a second row of at least one optical receiver element arranged at a height relative to the floor below the bottom rails;

a first detection member mounted at the first wall member and a second detection member mounted at the second wall member, the first row of optical transmitter elements being arranged on the first detection member, the first row of optical receiver elements being arranged on the second detection member, the second row of at least one optical transmitter element being arranged on the second detection member and the second row of at least one optical receiver element being mounted on the first detection member;

wherein the second row of at least one optical transmitter element on the second detection member are arranged to transmit only in response to detection by the first row of optical receiver elements of a condition in which no beams are detected thereby;

and a control circuit responsive to a condition in which the at least one optical receiver element of the second row is receiving the beam from the respective optical transmitter element of the second row for actuating the alarm means.

15. The combination according to claim 14 wherein the control circuit is substantially instantaneously, without delay responsive to the condition.

16. The combination according to claim 14 wherein the optical transmitter means includes a third row of optical transmitter elements arranged at a height from the floor equal to the rail height and wherein the optical receiver means includes a third row of optical receiver elements arranged at a height from the floor equal to the rail height.

17. The combination according to claim 14 wherein the first row of optical transmitter elements and the first row of optical receiver elements are arranged for detection by any one of the first row of optical receiver elements of a beam of any one of the first row of optical transmitter elements.

18. The combination according to claim 14 wherein the optical transmitter means and the optical receiver means are covered by a cover panel which is colored to allow transmission of light from the optical transmitter means while appearing visually sufficiently dark to prevent observation of the optical transmitter means.

19. The combination according to claim 14 wherein the check stand includes a first stand element having the first wall member thereon and a second stand element having the second wall member thereon, the first stand element having a further wall member opposed to the first wall member and the second stand element having a further wall member opposed to the second wall member, the further wall members forming adjacent alleyways and having thereon detection members from said adjacent alleyways, each of the stand elements having means for providing electrical power to both of the detection members thereon.

20. A combination comprising:

a cart for transporting goods including two bottom rails, a plurality of wheels beneath the bottom rails and a bottom rack mounted on the bottom rails for supporting goods thereon;

a check stand comprising a floor, a first and a second wall member each upstanding from the floor and defining between the wall members an alleyway through which persons and carts can pass;

detection means for detecting goods on the bottom rack of a cart as it passes through the alleyway and for providing a signal in response thereto;

and alarm means for indicating to a person at the check stand receipt of a signal from the detection means;

the detection means comprising:

optical transmitter means for transmitting a plurality of beams of light, optical receiver means responsive to receipt of light from at least one of the beams, the optical transmitter means and optical receiver means being arranged such that said plurality of beams of light are transmitted across the alleyway;

the optical transmitter means comprising a plurality of optical transmitter elements each arranged to transmit a respective one of the beams, and the optical receiver means comprising a plurality of optical receiver elements each responsive to at least one of the beams;

at least some of the optical transmitter elements and the optical receiver elements being mounted on a first detection member supported at the first wall member and at least some of the optical transmitter elements and optical receiver elements being mounted on a second detection member supported at the second wall member;

said at least some of the optical transmitter elements and the optical receiver elements of the first detection member being arranged in a two dimensional pattern in a vertical plane of the first detection member and said at least some of the optical transmitter elements and the optical receiver elements of the second detection member being arranged in a similar two dimensional pattern in a vertical plane of the second detection member;

the two dimensional patterns being arranged relative to a shape of the cart having goods on the bottom rack so as to be responsive to the shape of the cart having goods on the rack while being not responsive to the shape of a cart having an empty bottom rack and being not responsive to persons;

at least some of the optical transmitter elements being arranged to transmit the respective beams thereof simultaneously;

the first and second detection members being free from connecting wires therebetween and the sole communication therebetween being provided by said beams.

* * * * *